US006525286B2

(12) United States Patent
Koguchi et al.

(10) Patent No.: US 6,525,286 B2
(45) Date of Patent: Feb. 25, 2003

(54) TRIPLE ACTION PRESSURE SWITCH

(75) Inventors: Masayuki Koguchi, Tokyo (JP); Shingo Naganuma, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/051,184

(22) Filed: Jan. 22, 2002

(65) Prior Publication Data

US 2002/0100669 A1 Aug. 1, 2002

(30) Foreign Application Priority Data

Jan. 31, 2001 (JP) ..... 2001-023620

(51) Int. Cl.[7] ..... H01H 35/40
(52) U.S. Cl. ..... 200/834; 200/83 P
(58) Field of Search ..... 200/81 R, 83 P, 200/83 Y, 406, 576

(56) References Cited

U.S. PATENT DOCUMENTS

| | | | | |
|---|---|---|---|---|
| 4,820,890 A | * | 4/1989 | Tamura et al. | 200/81.4 |
| 4,827,094 A | * | 5/1989 | Tanaka et al. | 200/83 J |
| 4,853,504 A | * | 8/1989 | Tanaka et al. | 200/83 P |
| 4,939,321 A | * | 7/1990 | Tanaka et al. | 200/83 P |
| 4,948,931 A | * | 8/1990 | Nixon et al. | 200/83 P |

FOREIGN PATENT DOCUMENTS

| | | | |
|---|---|---|---|
| EP | 579867 | * | 11/1992 |
| JP | 1010536 | * | 1/1989 |
| JP | 1027137 | * | 1/1989 |
| JP | 1283726 | * | 11/1989 |
| JP | 6119856 | * | 4/1994 |

* cited by examiner

*Primary Examiner*—Elvin Enad
*Assistant Examiner*—Lisa N Klaus
(74) *Attorney, Agent, or Firm*—Rader, Fishman & Grauer PLLC

(57) ABSTRACT

A triple action pressure switch includes a first inversion plate, a first sliding member including an annular protrusion to the lower surface thereof, a second inversion plate with the upper surface thereof abutting against the annular protrusion, a second sliding member which stops the periphery rim of the second inversion plate at the upper surface thereof, a third inversion plate, a second actuating rod, a first actuating rod, a first electric switch segment including a first movable contact and a fixed contact coming into contact with the movable contact, and a second electric switch segment including a second movable contact and a third movable contact. The second inversion plate is two layered inversion plates with the diameter of 15 mm, and the diameter of a circle plotted by the annular protrusion provided to the lower surface of the first sliding member is set between 12 mm and 13.5 mm.

3 Claims, 6 Drawing Sheets

TRIPLE ACTION PRESSURE SWITCH

FIELD OF THE INVENTION

The present invention relates to a triple action pressure switch, which includes a function of detecting occurrence of abnormally high or low pressure in a refrigerant system of a refrigerator air conditioning system and of turning on an electric circuit triggered by detection, and includes also a third function of turning on/off other electric circuits accompanying the refrigeration system independently from the above-mentioned functions.

Specifically, the third function is used for turning on/off a fan motor of a condenser provided inside the refrigerating cycle.

DESCRIPTION OF THE RELATED ART

The Applicant of the present invention has already proposed a triple action pressure switch having the above-mentioned function (Japanese Patent Publication No. H7-114094).

The structure and operation of the above-mentioned conventional triple action pressure switch will be explained with reference to FIG. 3 and FIG. 4. FIG. 3 is a vertical cross-sectional view indicating the outline of the structure of the conventional triple action pressure switch, and FIG. 4 is a graph schematically indicating the characteristics of the operating pressure. The triple action pressure switch shown in FIG. 3 is illustrated upside down.

As is shown in FIG. 3, the switch of the conventional triple action pressure switch is constituted by assembling a housing 1, a switch case 2, a diaphragm 22, a first snap disc portion 3, a first sliding member 4, a second snap disc portion 5, a second sliding member 6, a third snap disc portion 7, a second actuating rod 24, a first actuating rod 23, a first electric switch segment SW1, and a second electric switch segment SW2, in a manner shown in FIG. 3.

The housing 1 is formed using galvanized mild steel or aluminum alloy. The housing 1 has at its upper region a coaxial path P connecting to the refrigeration system, that guides the pressure of the refrigerant to a pressure accepting chamber inside the housing.

The switch case 2 is formed using insulative material such as glass-fiber reinforced polybutylene telephthalate (PBT). The switch case 2 is divided via a divisional wall A into an upper hollow B for storing functioning components of the switch, and a lower hollow C for storing two pairs of terminal members 12, 13, and 19 (only one of the two is shown), a total of four terminal members, which pierce through the divisional wall A downwardly in a manner so that the two pairs are orthogonal to each other.

The upper hollow B of the switch case 2 is assembled with the housing 1, is fixed by caulking the lower end of the housing 1 in a manner shown in the drawing, to form a space B for storing the pressure switch portion therein. The outer wall of the lower hollow C is assembled with a connector of an electrical system of the refrigeration system.

The diaphragm 22 is formed using a thin film of polyimide resin, for example, and is fixed air tightly between the housing 1 and the switch case 2 with a gasket 21 made of elastic material during assembling of the housing 1 and the switch case 2. The diaphragm 22 divides the space B and the fluid space connecting to the path P, and functions to prevent the refrigerant gas from penetrating into the switch case, and to transmit the refrigerant pressure to the pressure transmitting members inside the switch case.

Each of the first, second and third snap disc portions used in the triple action pressure switch are formed of so-called inversion plates having dish-like shapes with a region projecting from one of the surfaces and having a slope section at the periphery thereof, and having a hysteresis property that the projecting region inverts to the opposite direction when a pressure larger than a predetermined value is provided from the projecting region side, and inverts again to the original position when the pressure decreases below the predetermined value.

By constituting the snap disc portion using a plurality of inversion plates, durability can be enhanced as well as achieving a design minimizing the dispersion of operating values. However, there arouses a fear of friction occurring between each surfaces of the snap discs contacting each other, causing unstable operation of the snap discs. In order to reduce the friction, a lubricant containing a small amount of solid molybdenum disulfide powder is applied to the interface of the layered snap discs. This results in stabilizing the operation of the snap discs incredibly.

The first snap disc portion (inversion plate) 3 is formed by layering a plurality of inversion plates, and the peripheral rim thereof is stored to a snap disc receiver provided to the upper surface of the first sliding member 4 and is stopped by an outer peripheral wall 4*a*, so that the upper surface of the projecting region and the slope portion of the first snap disc portion 3 abuts against the lower surface of the diaphragm 22.

The first snap disc portion 3 functions to sense the intermediate pressure PM and PM–DELTA PM.

The first sliding member 4 includes the outer peripheral wall 4*a* forming the snap disc receiver to the upper surface thereof, a concentrical annular protrusion 4*b* to the lower surface thereof, and a hollow hole 27 to the center thereof. The outer periphery of the first sliding member 4 slides directly against the inner wall of the switch case 2. The peripheral rim of the first snap disc portion 3 stored inside the snap disc receiver is stopped against the inner surface of the outer peripheral wall 4*a* of the first sliding member 4. The first actuating rod 23 is positioned so as to pierce through the hollow hole 27. The annular protrusion 4*b* is positioned so as to abut against the upper slope portion of the second snap disc portion 5.

The second snap disc portion (inversion plate) 5 is formed using three snap discs, and includes a hole H at the center thereof. The annular protrusion 4*b* of the first sliding member 4 abuts against the upper slope portion of the second snap disc portion 5. The hole H provided at the central axis of the second snap disc portion 5 does not interfere with the first actuating rod 23, and the rod pierces freely therethrough. Generally, the snap disc having a hole suffers from defects such as having large dispersion in operation, and having inferior durability. By constituting the same in a unit of three plates, the pressure of the operating pressure can be borne tripartitely, and the dispersion in operation can be restrained by providing some degree of freedom to the design of the individual plates. In this case, as is mentioned earlier, the friction between the contacting surfaces of the snap discs can be reduced by plating the lubricant containing solid molybdenum disulfide thereto.

The second snap disc 5 is supported by the snap disc receiver provided to the upper surface of the second sliding member 6, and the peripheral rim thereof is stopped against the inner surface of the outer peripheral wall 5*a*.

The second snap disc portion 5 functions to sense high pressure cut off pressure PH and PH–DELTA PH.

The second sliding member 6 includes the snap disc receiver and the outer peripheral wall 5*a* surrounding the same to the upper surface thereof, a central axis hole 28 concentric to the hole H to the central portion thereof, and a central projection 25 projecting from the periphery of the central axis hole 28 to the lower surface thereof. The peripheral rim of the second snap disc portion 5 is stored inside the snap disc receiver at the upper surface of the second sliding member 6, and the periphery thereof is stopped against the inner surface of the outer peripheral wall 5*a*. The outer periphery of the second sliding member 6 slides directly against the inner wall of the switch case 2. The central axis hole 28 is of a diameter larger than that of the central axis hole 27 of the first sliding member 4, and is pierced by a cylindrical second actuating rod 24 having substantially no distinction as to which end is top or bottom. The central axis hole 27 and the second actuating rod extends downwardly. The first actuating rod 23 mentioned above pierces through the second actuating rod 24.

A step-like flat region is provided to the base of the central projection 25, with which a central axis hollow hole 30 of the third snap disc portion is assembled.

The third snap disc portion 7 includes a first form of projecting towards the diaphragm 22 side, similar to the first snap disc 3 and the second snap disc 5, and includes the central axis hollow hole 30 to be assembled to the flat region provided to the base of the central projection 25 of the second sliding member 6. With the assembly of the central axis hollow hole 30 and the flat region, the force from the fluid pressure is received via the diaphragm 22, the first sliding member 4, and the second sliding member 6. The inner periphery of the third snap disc portion (inversion plate) 7 is assembled with the side surface of the central projection 25, and the outer periphery thereof is stopped against the inner wall step region of the switch case 2.

The third snap disc portion 7 functions to sense low pressure cut-off pressure PL and PL+DELTA PL.

By providing a step region 26 to the inner wall of the switch case 2, a limit is provided to the sliding distance of the first sliding member 4 and the second sliding member 6, so that the third snap disc 7 is free from being exposed to excess pressure after deformation. Therefore, the operation of the third snap disc 7 is prevented from being destroyed from the elapse of time.

The second actuating rod 24 includes a hollow hole 29 through which the first actuating rod 23 pierces at the central axis thereof. The second actuating rod 24 abuts against the lower surface of the second snap disc portion 5 at the upper end thereof, and pierces through the central axis hole 28 of the second sliding member 6. The second actuating rod 24 transmits the force from deformation of the second snap disc 5.

The first actuating rod 23 abuts against the lower surface of the fist snap disc portion 3 at the upper end thereof, and pierces through the hollow hole 27 of the first sliding member 4, the hole H of the second snap disc portion 5, and the interior of the second actuating rod 24. The first actuating rod 23 extends downwardly without interfering with the second sliding member 6, the second actuating rod 24 and the second electric switch segment SW2, and transmits force to a switch lever 18 of the first electric switch segment SW1.

The first electric switch segment SW1 comprises a first movable contact 15 provided to the leading end of the switch lever 18 connecting with the lower end of the first actuating rod 23, and a fixed contact 14 coming into contact with the first movable contact 15. The first electric switch segment SW1 is installed at the lowermost region of the upper hollow B of the switch case 2, and is comprised of the upwardly biased switch lever 18 having fixed points on the pair of terminal member 12 and terminal member 13 extending to the lower hollow C of the switch case 2, the movable contact 15 provided at the upper surface of the other end of the switch lever 18, and the fixed contact 14 facing the movable contact 15. The fixed contact 14 and the terminal member 12 are fixed to the switch case 2 at the identical spot.

The second electric switch segment SW2 is comprised of a second movable contact 10 provided at the leading end of a second switch lever 16 connecting with the lower end of the second actuating rod 24, and a third movable contact 11 provided to the leading end of a third switch lever 17 connecting with the lower end of the central projection 25, which comes into contact with the second movable contact 10.

The second electric switch segment SW2 is comprised of the first switch lever 17 fixed at one end as a fixed end 8, the first movable contact 11 provided to the leading end thereof, the second switch lever 16 positioned approximately parallel to and below the first switch lever and fixed at one end as a fixed end 9, and the second movable contact 10 provided to the leading end of the second switch lever 16 so as to face the first movable contact 11. The fixed end 8 of the first switch lever 17 and the fixed end 9 of the second switch lever 16 are electrically connected to the second pair of terminal members 19.

The second pair of terminal member 19 extends downwardly through the partitioning wall of the switch lever, and is provided so as to cross at a right angle with the first pair of terminal members 12, 13. Therefore, only one of the pair of terminal members 19 is illustrated in the drawing.

The first snap disc portion 3 takes a stable configuration of conical platform projecting upward as is illustrated in the figure with the pressure PM or less. When the first snap disc portion 3 receives fluid pressure PM or more to the upper surface thereof via the diaphragm 22, the snap disc transforms to a second configuration, where the central axis portion thereof is displaced downwardly by the snap effect. This displacement pushes down the first actuating rod 23, presses the switch lever 18 of the first electric switch segment SW1, and electrically opens the contact 14 and the contact 15.

The first snap disc portion (inversion plate) 3 returns from the second configuration to the original configuration when the fluid pressure recovers to PM−DELTA PM, and as a result, the force pressing the switch lever 18 of the first electric switch segment SW1 via the first actuating rod 23 disappears. This causes an operation opposite to that mentioned in the case where the pressure reached PM, and electrically closes the fixed contact 14 and the movable contact 15 of the first electric switch segment SW1.

The second snap disc portion 5 transforms from the first stable configuration with the snap disc projecting upward as is illustrated in the drawing, to the second configuration where the central axis portion thereof is displaced downwardly, by the snap effect when the fluid pressure elevates and reaches a predetermined value of PH. This motion is transmitted to the second switch lever 16 of the second electric switch segment SW2 via the second actuating rod 24.

The second actuating rod 24 transmits the motion of the second snap disc 5 transforming with the snap effect to the second configuration under pressure PH to the central portion of the second switch lever 16 of the second electric switch, and pushes down the second movable contact 10 resisting against the upward bias force of the switch lever.

The peripheral rim of the third snap disc portion 7 is stored in the receiving area provided to the inner wall of the switch case. The third snap disc portion 7 takes the configuration illustrated in the drawing when the fluid pressure is lower than PL+DELTA PL, and transforms to the second configuration where the central portion thereof is displaced downwardly accompanying a snap effect, when the fluid pressures reaches PL+DELTA PL.

With this action, the second sliding member 6 slides downwards, so that the central projection 25 also moves downwards. This motion is transmitted to the switch lever 17 of the second electric switch segment SW2, so that the second electric switch segment SW2 is electrically closed. When the fluid pressure elevates to a normal pressure and then lowers to an abnormally low pressure PL again, the third snap disc returns to its original configuration, and pushes up the second sliding member 6. The central projection 25 loses its force on the second electric switch segment SW2, so that the second electric switch segment SW2 is opened.

The action of the triple action pressure switch having the structure mentioned above will be explained with reference to FIG. 4. When a fluid pressure PL+DELTA PL is applied to the diaphragm 22, the load is applied to the third snap disc portion 7 via the first snap disc portion 3, the first sliding member 4, the second snap disc portion 5, and the second sliding member 6. With such load, the third snap disc portion 7 snap-operates to the electric switch segment side, the second sliding member 6 moves to the electric switch segment side, the central projection 25 of the second sliding member 6 pushes down the first switch lever 17 of the second electric switch segment SW2 so that the first movable contact 11 comes into contact with the second movable contact 10, and closes the second electric switch segment SW2.

At this time, the lower surface near the outer periphery of the second sliding member 6 is supported by the step region 26 provided to the interior of the switch case 2, so that it is prevented from moving further to the electrical switch side.

When the fluid pressure further elevates and reaches pressure PM, the first snap disc portion 3 snap-operates to the switch segment side, the first actuating rod 23 moves to the first electric switch segment SW1 side and pushes down the switch lever 18 of the first electric switch segment SW1, separates the movable contact 15 from the fixed contact 14, and opens the first electric switch segment SW1.

When the fluid pressure further elevates and reaches pressure PH, the first sliding member 4 moves to the electric switch side, the annular protrusion 4*b* of the first sliding member 4 forces the second snap disc portion 5 to snap-operate to the electric switch side, the second actuating rod 24 pushes down the second switch lever 16 of the second electric switch segment SW2 to separate the second movable contact 10 from the first movable contact 11, and opens the second electric switch segment SW2.

When the fluid pressure drops from PH to PH−DELTA PH, the second snap disc portion 5 returns to its original configuration, resulting in reducing the downward force on the second actuating rod 24. Therefore, the second switch lever 16 moves upward by self-resiliency and the second movable contact 10 comes into contact with the first movable contact 11, so that the second electric switch segment SW2 is closed.

When the fluid pressure further drops to PM−DELTA PM, the first snap disc portion 3 restores from the second configuration, resulting in dissolving the downward force on the first actuating rod 23. Therefore, the first switch lever 18 restores with its resilient force and the movable contact 15 is pressed against the fixed contact 14, so that the first electric switch segment SW1 is closed.

When the fluid pressure further drops to PL, the third snap disc portion 7 restores from the second configuration, resulting in removing the downward force on the central projection 25 of the second sliding member 6. Therefore, the second movable contact 11 is separated from the first movable contact 10 with the resilient force of the first switch lever 17, so that the second electric switch portion SW2 is opened.

In this case, the numerical value of the set pressure, in gage pressure, is as follows: PH=2.65 MPa, PH−DELTA PH=2.15 MPa, PL+DELTA PL=250 KPa, PL=210 KPa, PM=1.47 MPa, and PM−DELTA PM=1.08 MPa.

Thus, the triple action pressure switch can perform triple action, with respective hysteresis properties.

The triple action pressure switch with structure mentioned above is constructed in following sizes.

Snap disc: outer diameter=15 mm, thickness=0.254 mm, diameter of the projecting region=8 mm, height of the projecting region=0.71 mm.

First sliding member: outer diameter=17.4 mm, inner diameter of the snap disc receiver=15.2 mm, depth of the snap disc receiver=0.80 mm, diameter of the apex forming the annular protrusion=12 mm.

Second sliding member: outer diameter=17.4 mm, inner diameter of the snap disc receiver=15.2 mm, depth of the snap disc receiver=0.85 mm.

In such triple action pressure switch, the second snap disc portion 5 is formed by layering three snap discs having the shape mentioned above. However, in assembling the snap disc portion 5, the alignment of each of the snap discs becomes difficult as the number of the snap discs used increases. This results in increasing the production process as well as increasing the components needed, and becomes a factor for obstructing cost reduction.

When constructing the second snap disc portion with two snap discs as is in the conventional case in trying to solve the problem mentioned above, the operating pressure drops so that a triple action pressure switch having the identical operating condition cannot be obtained. In order for the triple action pressure switch with the second snap disc portion formed with two snap discs to obtain the identical operating condition with the conventional switch, there arouses a problem that the snap disc must be of a specification different from that of the conventional disc in having a higher inversion pressure.

SUMMARY OF THE INVENTION

The present invention aims to provide a triple action pressure switch having identical operating conditions as the conventional triple action pressure switch but requiring less number of components, without drastically changing the shape, structure and specification of the conventional triple action pressure switch.

In order to solve the problem mentioned above, the present invention is characterized in positioning the apex of an annular protrusion provided to the lower surface of a first sliding member for transmitting the pressure of fluid to a second snap disc portion to the vicinity of the peripheral rim of the second snap disc portion, in a triple action pressure switch forming the second snap disc portion using two snap discs.

That is, the present invention provides a triple action pressure switch comprising:

a housing including a path for introducing fluid pressure;

a switch case interlocking with the housing;

a diaphragm fixed air tightly between the housing and the switch case;

a first inversion plate with the upper surface thereof abutting against the lower surface of the diaphragm;

a first sliding member stopping the peripheral rim of the first inversion plate at the upper surface thereof, and including an annular protrusion at the lower surface thereof and a hollow hole at the center thereof, with the outer periphery thereof sliding directly against the inner wall of the switch case;

a second inversion plate with the upper surface thereof abutting against the annular protrusion, and including a hole at the center portion thereof;

a second sliding member stopping the peripheral rim of the second inversion plate at the upper surface thereof, and including a central axis hole at the center thereof being concentric with the hole and a central projection protruding from the periphery of the central axis hole at the lower surface thereof, with the outer periphery thereof sliding directly against the inner wall of the switch case;

a third inversion plate with the inner periphery thereof interlocking with the side surface of the central projection and with the outer periphery thereof stopped by a step region of the inner wall of the switch case;

a second actuating rod abutting at the upper end thereof against the lower surface of the second inversion plate, and piercing the central axis hole of the second sliding member;

a first actuating rod abutting at the upper end thereof against the lower surface of the first inversion plate, and piercing the hollow hole, the hole, and the interior of the second actuating rod;

a first electric switch segment comprising a first movable contact that connects with the lower end of the first actuating rod, and a fixed contact that comes into contact with the first movable contact; and a second electric switch segment comprising a second movable contact that connects with the lower end of the second actuating rod, and a third movable contact that connects with the central projection and comes into contact with the second movable contact;

wherein the second inversion plate is formed by layering two inversion plates having an outer diameter Sd of 15 mm; and a diameter Rd plotted by the apex of said annular protrusion provided to the lower surface of the first sliding member is within the range of 12 mm<Rd<13.5 mm.

Further, the present invention provides a triple action pressure switch comprising:

a housing including a path for introducing fluid pressure;

a switch case interlocking with the housing;

a diaphragm fixed airtightly between the housing and the switch case;

a first inversion plate with the upper surface thereof abutting against the lower surface of the diaphragm;

a first sliding member stopping the peripheral rim of the first inversion plate at the upper surface thereof, and including an annular protrusion at the lower surface thereof and a hollow hole at the center thereof, with the outer periphery thereof sliding directly against the inner wall of the switch case;

a second inversion plate with the upper surface thereof abutting against the annular protrusion, and including a hole at the center portion thereof;

a second sliding member stopping the peripheral rim of the second inversion plate at the upper surface thereof, and including a central axis hole at the center thereof being concentric with the hole and a central projection protruding from the periphery of the central axis hole at the lower surface thereof, with the outer periphery thereof sliding directly against the inner wall of the switch case;

a third inversion plate with the inner periphery thereof interlocking with the side surface of the central projection and with the outer periphery thereof stopped by a step region of the inner wall of the switch case;

a second actuating rod abutting at the upper end thereof against the lower surface of the second inversion plate, and piercing the central axis hole of the second sliding member;

a first actuating rod abutting at the upper end thereof against the lower surface of the first inversion plate, and piercing the hollow hole, the hole, and the interior of the second actuating rod;

a first electric switch segment comprising a first movable contact that connects with the lower end of the first actuating rod, and a fixed contact that comes into contact with the first movable contact; and a second electric switch segment comprising a second movable contact that connects with the lower end of the second actuating rod, and a third movable contact that connects with the central projection and comes into contact with the second movable contact;

wherein the second inversion plate is formed by layering two inversion plates; and the ratio between a diameter Sd of the second inversion plate and a diameter Rd of a circle plotted by the apex of the annular protrusion provided to the lower surface of the first sliding member (Rd/Sd) is within the range of $0.8<(Rd/Sd)<0.9$.

Moreover, the present invention provides a triple action pressure switch comprising:

a housing including a path for introducing fluid pressure;

a switch case interlocking with the housing;

a diaphragm fixed airtightly between the housing and the switch case;

a first inversion plate with the upper surface thereof abutting against the lower surface of the diaphragm;

a first sliding member stopping the peripheral rim of the first inversion plate at the upper surface thereof, and including an annular protrusion at the lower surface thereof and a hollow hole at the center thereof, with the outer periphery thereof sliding directly against the inner wall of the switch case;

a second inversion plate with the upper surface thereof abutting against the annular protrusion, and including a hole at the center portion thereof;

a second sliding member stopping the peripheral rim of the second inversion plate at the upper surface thereof, and including a central axis hole at the center thereof being concentric with the hole and a central projection protruding from the periphery of the central axis hole at the lower surface thereof, with the outer periphery thereof sliding directly against the inner wall of the switch case;

a third inversion plate with the inner periphery thereof interlocking with the side surface of the central projection and with the outer periphery thereof stopped by a step region of the inner wall of the switch case;

a second actuating rod abutting at the upper end thereof against the lower surface of the second inversion plate, and piercing the central axis hole of the second sliding member;

a first actuating rod abutting at the upper end thereof against the lower surface of the first inversion plate, and piercing the hollow hole, the hole, and the interior of the second actuating rod;

a first electric switch segment comprising a first movable contact that connects with the lower end of the first actuating rod, and a fixed contact that comes into contact with the first movable contact; and a second electric switch segment comprising a second movable contact that connects with the lower end of the second actuating rod, and a third movable contact that connects with the central projection and comes into contact with the second movable contact;

wherein the second inversion plate is formed by layering two inversion plates; and the ratio between an inner diameter HSd of a snap disc receiver of the second sliding member and a diameter Rd of a circle plotted by the apex of the annular protrusion provided to the lower surface of the first sliding member (Rd/HSd) is within the range of 0.79<(Rd/HSd)<0.89.

DETAILED DESCRIPTION OF PREFERRED EMBODIMENTS

Figure 3:
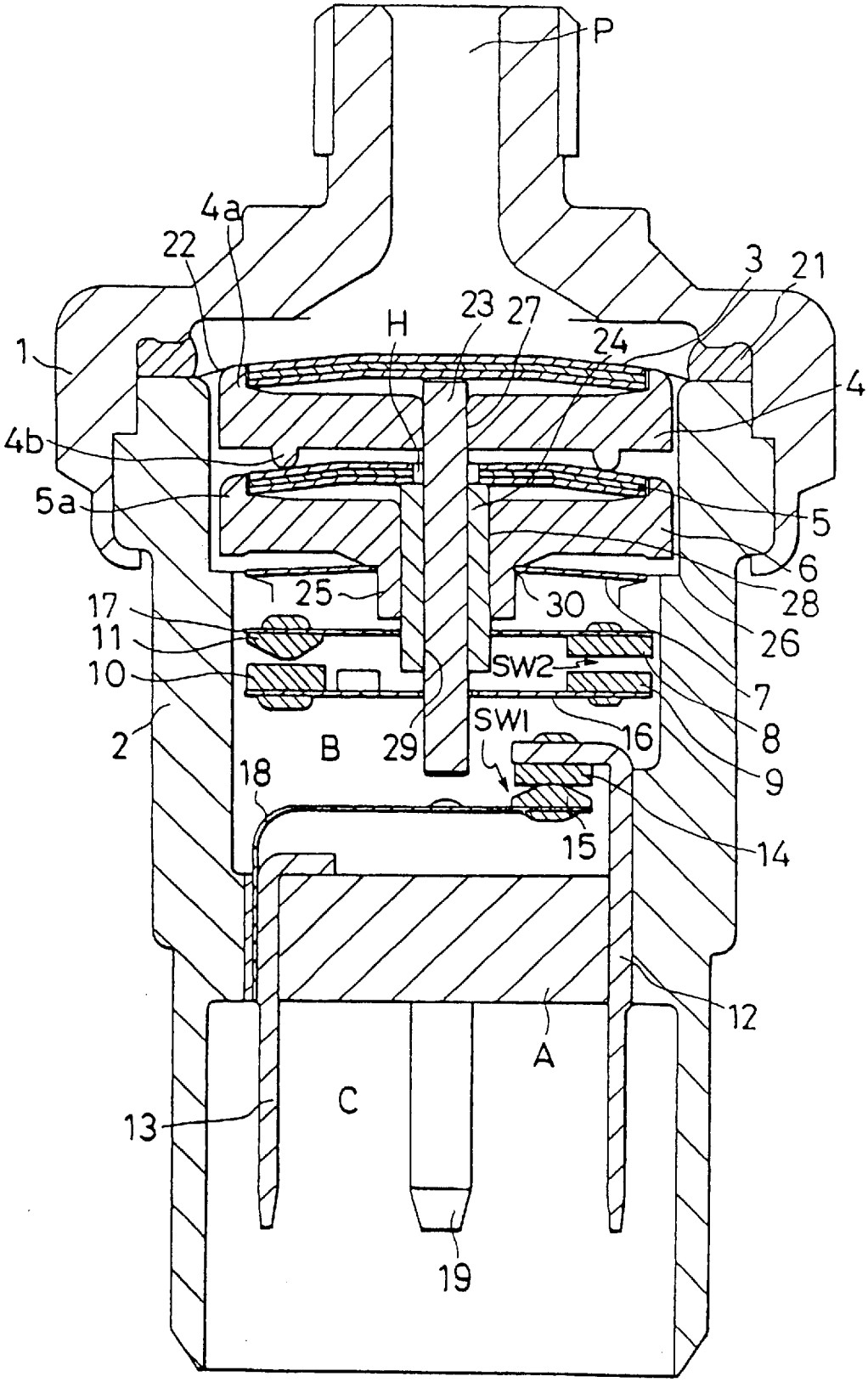
FIG. 3 is a vertical cross-sectional view explaining the structure of the triple action pressure switch.

The triple action pressure switch according to the present invention will now be explained. The structure and the operation of the pressure switch itself is identical to those of the conventional triple action pressure switch shown in FIG. 3, except for the following differences.

That is, the triple action pressure switch according to the present invention differs from the structure of the conventional triple action pressure switch in forming a second snap disc portion 5 by layering two snap discs, in setting a diameter Rd of the apex of an annular protrusion 4*b* provided to the lower surface of a first sliding member 4 greater than 12 mm and less than 13.5 mm (12 mm<Rd<13.5 mm), and in setting the depth of a snap disc receiver of a second sliding member 6 at 0.60 mm.

Figure 1:
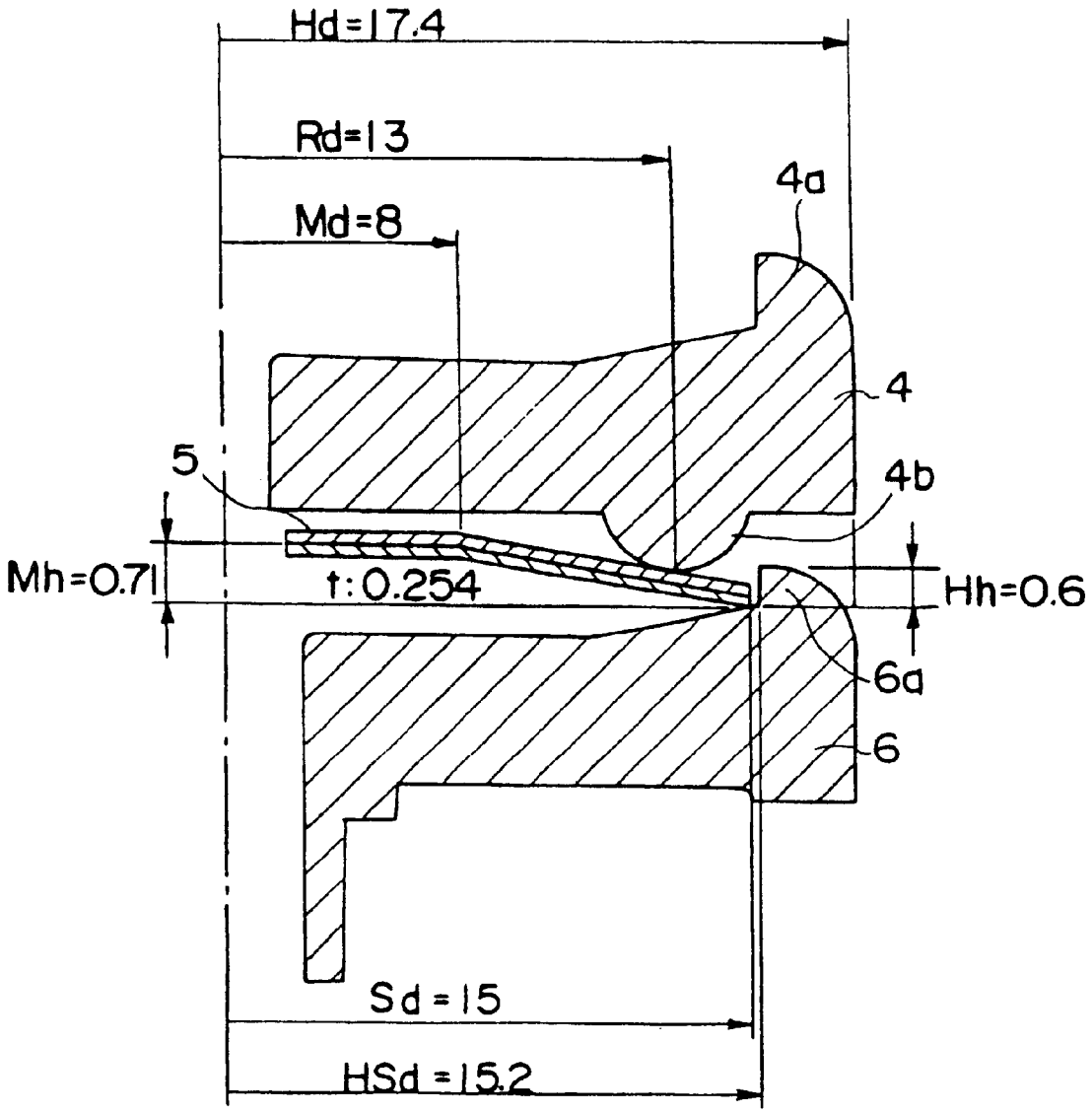
FIG. 1 is a partially-enlarged vertical cross-sectional view explaining the structure of the triple action pressure switch according to the present invention.

The relation between the size of the first sliding member 4, the second snap disc portion 5, and the second sliding member 6 of the triple action pressure switch according to the present invention will be explained with reference to partial vertical cross-sectional view of FIG. 1. The first sliding member 4 is designed to have an outer diameter Hd of 17.4 mm, an inner diameter of the snap disc receiver of 15.2 mm, and a diameter Rd of the circle plotted by the apex of the annular protrusion 4*b* provided to the lower surface thereof of 13 mm. Also, the two snap discs forming the second snap disc portion 5 is designed to have a thickness t of 0.254 mm, an outer diameter Sd of 15 mm, a diameter Md of the projecting region of 8 mm, and a height Mh of the projecting region of 0.71 mm. Moreover, the second sliding member 6 is designed to have an outer diameter Hd of 17.4 mm, an inner diameter HSd of the snap disc receiver of 15.2 mm, and the height of the snap disc receiver, that is, the height Hh of an outer peripheral wall 6*a* of 0.6 mm.

The relation between the diameter Rd (mm) of the circle plottedbythe apex of the annular protrusion of the first sliding member 4 and the operating pressure (MPaG) at the second snap disc portion 5 will be explained with reference to FIG. 2, taking the number of snap discs as the parameter. The diameter Rd of the circle plotted by the apex of the annular protrusion of the first sliding member 4 indicates the point of application, the point where the fluid pressure is provided to the slope of the snap disc. Also, the point where the peripheral rim of the snap disc is supported, that is, the outer diameter Sd of the snap disc, indicates the point of support. In the drawing, the ratio (Rd/Sd) between the point of application (the diameter Rd of the circle plotted by the apex of the annular protrusion 4*b* of the first sliding member 4) and the point of support (the outer diameter Sd of the snap disc) is indicated below the diameter Rd of the annular protrusion which is given as a transverse axis, and the radio (Rd/HSd) between the diameter Rd of the circle plotted by the apex of the annular protrusion 4*b* of the first sliding member 4 and the inner diameter HSd of the snap disc receiver of the first sliding member 4 is indicated further below.

Figure 2:
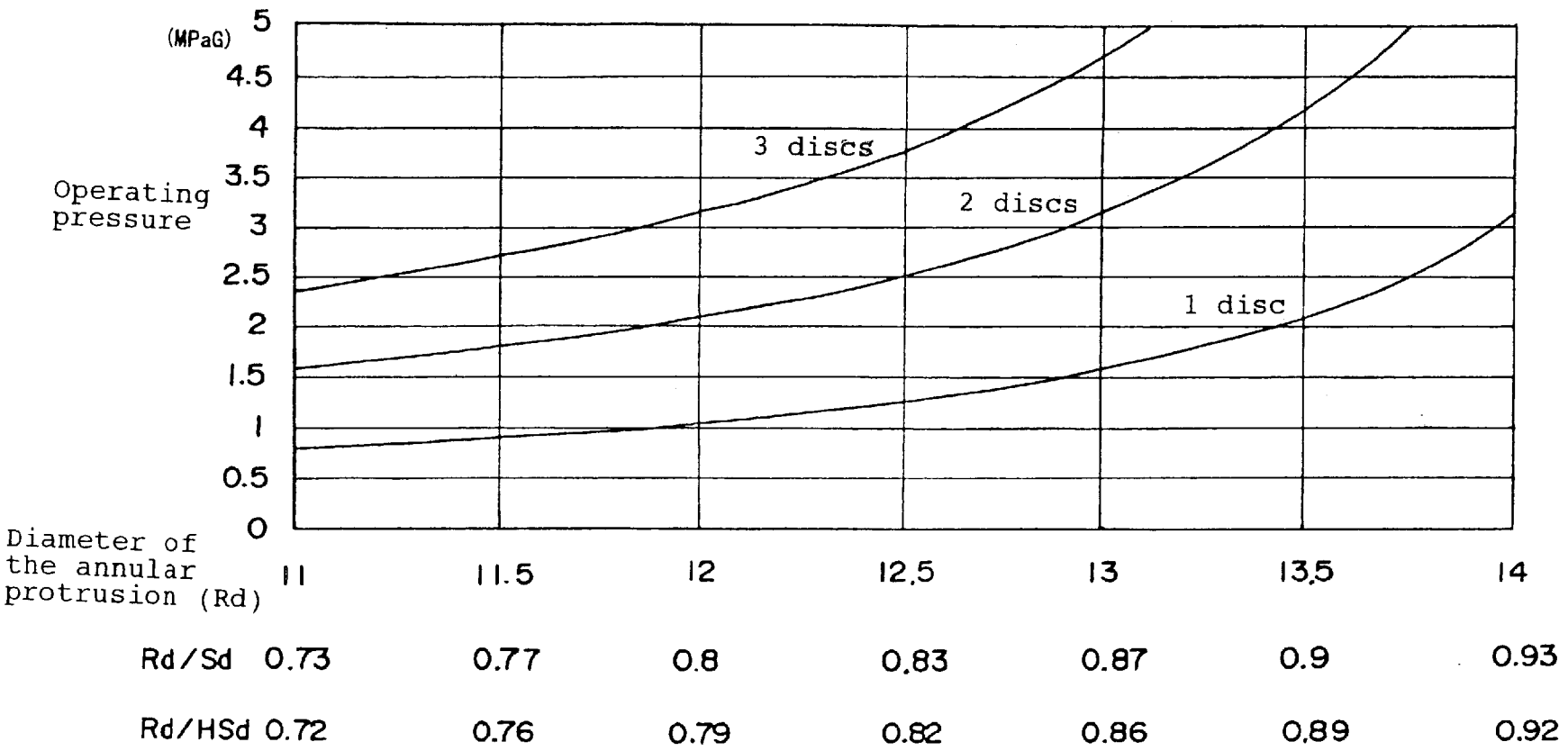
FIG. 2 is a graph explaining the operating characteristics of the snap disc.

As is indicated in FIG. 2, the conventional triple action pressure switch uses three layered snap discs, with the diameter Sd of the snap disc being 15 mm, the diameter Rd of the circle plotted by the apex of the annular protrusion 4*b* of the first sliding member 4 being 12 mm (Rd/Sd=0.8), so that the operating pressure becomes 3.14 MPaG. In obtaining the identical operating pressure with two layered snap discs, the diameter Rd of the circle plotted by the apex of the annular protrusion 4*b* of the first sliding member 4 should be 13 mm (Rd/Sd 0.87) In trying to obtain the equivalent operating pressure with a single snap disc, the diameter Rd of the circle plotted by the apex of the annular protrusion 4*b* of the first sliding member 4 must be 14 mm (Rd/Sd=0.93). With such design, the annular protrusion 4*b* interfere with the outer peripheral wall 6*a* of the second sliding member 6, so that the switch cannot operate precisely.

In using two snap discs, there arouses a similar fear of the annular protrusion 4*b* interfering with the outer peripheral wall 6*a* of the second sliding member 6, when the diameter Rd of the circle plotted by the apex of the annular protrusion 4*b* of the first sliding member 4 is set at 13.5 mm (Rd/Sd=0.9). Therefore, the diameter Rd of the circle plotted by the apex of the annular protrusion 4*b* of the first sliding member 4 must be less than 13.5 mm (Rd/Sd=0.9).

As is seen from above, the present invention can obtain the equivalent operating pressure as that of the case using three snap discs, by setting the diameter Rd of the apex of the annular protrusion 4*b* provided to the first sliding member 4 to be larger than when using three snap discs, that is, setting the diameter to be greater than 12 mm and less than 13.5 mm (12 mm <Rd <13.5 mm), in other words, setting the ratio between the diameter Rd of the circle plotted by the apex of the annular protrusion 4*b* of the first sliding member 4 and the diameter Sd of the second snap disc 5 (Rd/Sd) to be greater than 0.73 and less than 0.9, and further setting the ratio between the diameter Rd of the circle plotted by the apex of the annular protrusion 4*b* of the first sliding member 4 and the inner diameter HSd of the snap disc receiver of the second sliding member 4 (Rd/HSd) to be greater than 0.72 and less than 0.89.

With such structure, the assembly of the snap discs can be simplified than in the case of using three snap discs, and the number of components needed can be reduced by merely changing the size of some of the components of the conventional triple action pressure switch, that is, the size of the annular rib of the first sliding member 4 and the depth of the snap disc receiver of the second sliding member. Therefore, the cost of manufacturing the triple action pressure switch can be reduced.

Figure 4:
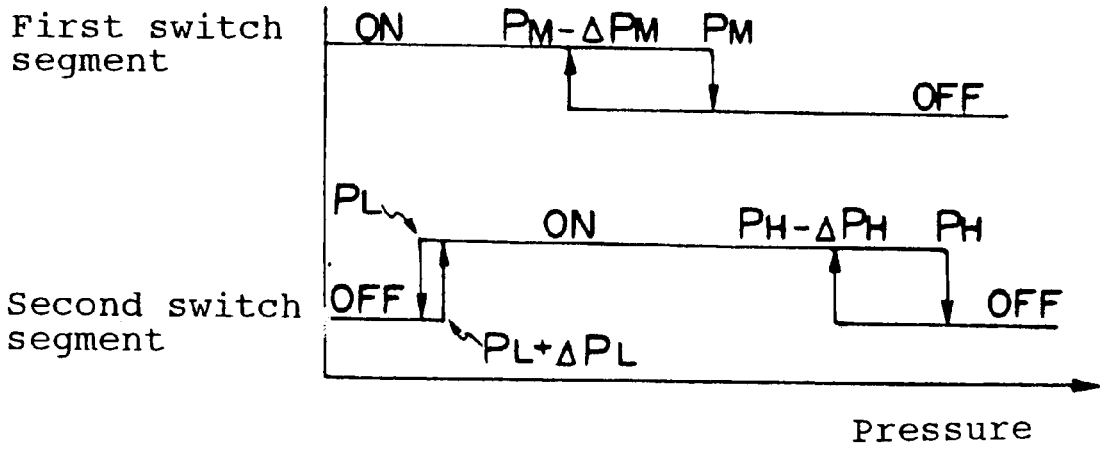
FIG. 4 is a graph explaining the characteristics of the operating pressure of the triple action pressure switch.
Figure 5:
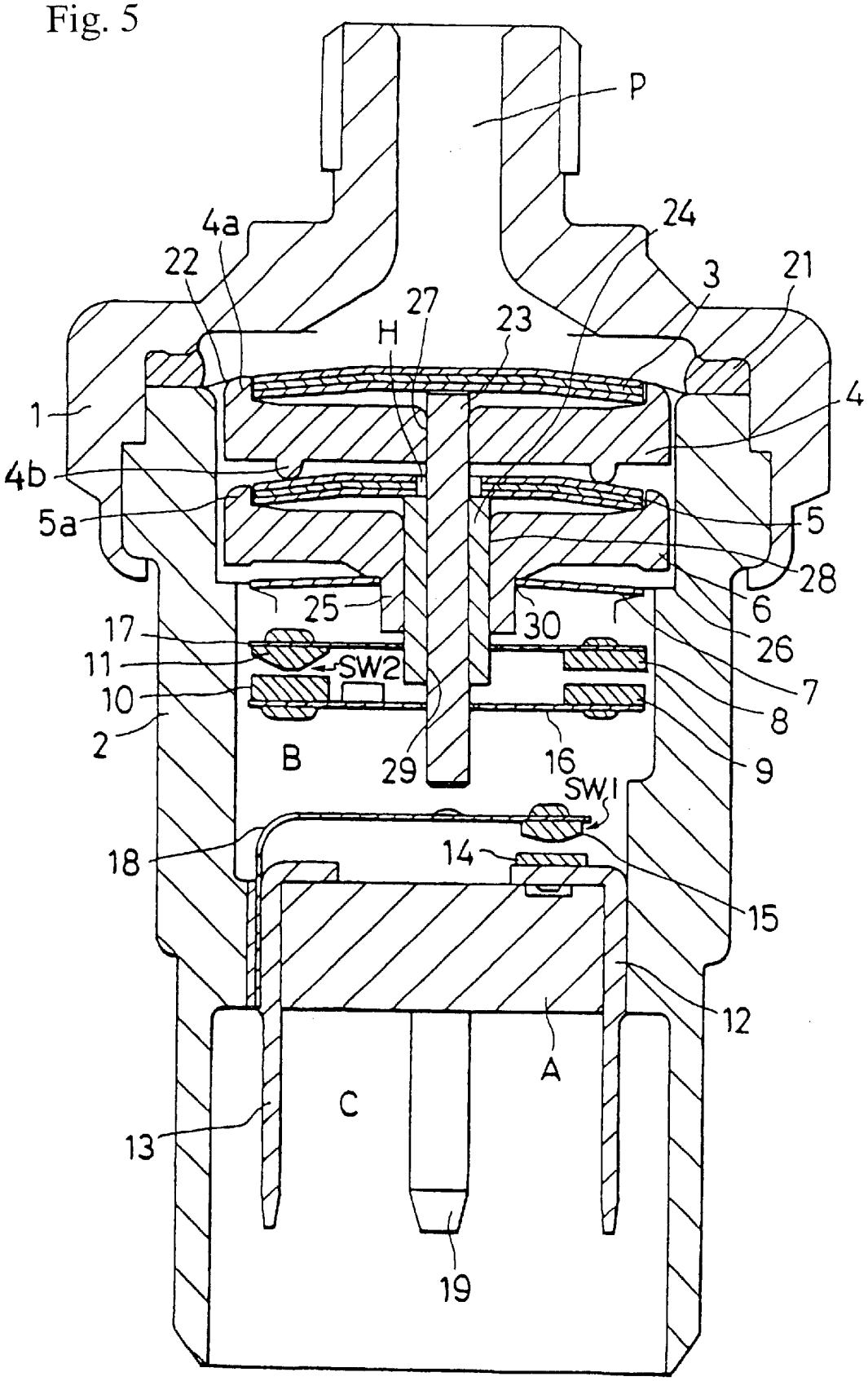
FIG. 5 is a vertical cross-sectional view explaining another embodiment of the triple action pressure switch.
Figure 6:
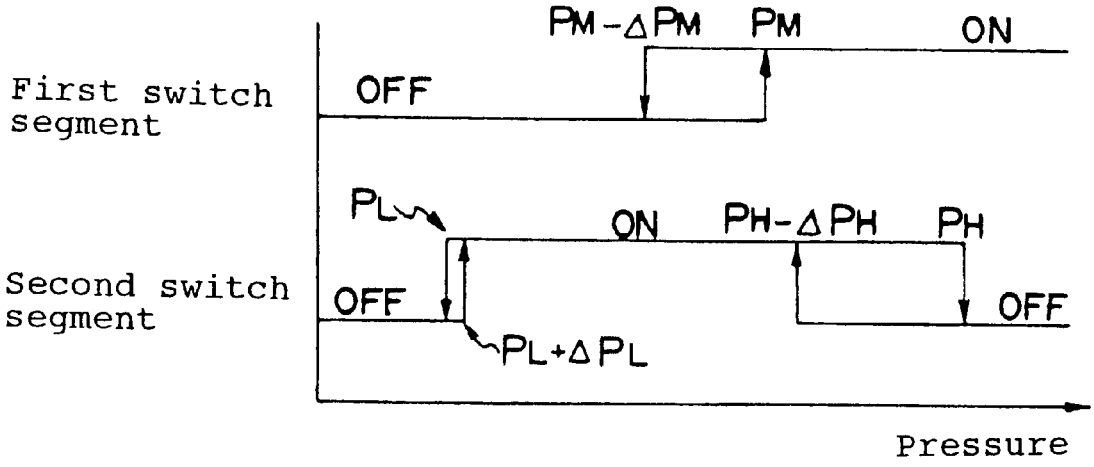
FIG. 6 is a graph explaining the characteristics of the operating pressure of the triple action pressure switch shown in FIG. 5.

Another embodiment of the triple action pressure switch with the present invention applied thereto will now be explained with reference to FIG. 5 and FIG. 6. This embodiment is of the structure of closing the first electric switch segment SW1 when the fluid pressure exceeds pressure PM, with the fixed same when the pressure drops to PM—DELTA PM, with the fixed contact 14 of the first electric switch segment SW1 being provided at a position further away from the first snap disc portion 3 than the movable contact 15. The other structures are the same as those shown in FIG. 4.

According to the present invention, the triple action pressure switch that operates in an almost identical manner as the conventional triple operates in an almost identical manner without drastically changing the shape of the components but by reducing the number of snap discs needed. Therefore, the cost of manufacturing can be reduced.

We claim:

1. A triple action pressure switch comprising:

a housing including a path for introducing fluid pressure;

a switch case interlocking with said housing;

a diaphragm fixed airtightly between said housing and said switch case;

a first inversion plate with the upper surface thereof abutting against the lower surface of said diaphragm;

a first sliding member stopping the peripheral rim of said first inversion plate at the upper surface thereof, and including an annular protrusion at the lower surface thereof and a hollow hole at the center thereof, with the outer periphery thereof sliding directly against the inner wall of said switch case;

a second inversion plate with the upper surface thereof abutting against said annular protrusion, and including a hole at the center portion thereof;

a second sliding member stopping the peripheral rim of said second inversion plate at the upper surface thereof, and including a central axis hole at the center thereof being concentric with said hole and a central projection protruding from the periphery of said central axis hole at the lower surface thereof, with the outer periphery thereof sliding directly against the inner wall of said switch case;

a third inversion plate with the inner periphery thereon interlocking with the side surface of said central projection and with the outer periphery thereof stopped by a step region of the inner wall of said switch case;

a second actuating rod abutting at the upper end thereof against the lower surface of said second inversion plate, and piercing said central axis hole of said second sliding member;

a first actuating rod abutting at the upper end thereof against the lower surface of said first inversion plate, and piercing said hollow hole, said hole, and the interior of said second actuating rod;

a first electric switch segment comprising a first movable contact that connects with the lower end of said first actuating rod, and a fixed contact that comes into contact with said first movable contact; and a second electric switch segment comprising a second movable contact that connects with the lower end of said second actuating rod, and a third movable contact that connects with said central projection and comes into contact with said second movable contact;

wherein said second inversion plate is formed by layering two inversion plates having an outer diameter of 15 mm; and a diameter Rd plotted by the apex of said annular protrusion provided to the lower surface of said first sliding member is within the range of 12 mm <Rd <13.5 mm.

2. A triple action pressure switch comprising:

a housing including a path for introducing fluid pressure;

a switch case interlocking with said housing;

a diaphragm fixed airtightly between said housing and said switch case;

a first inversion plate with the upper surface thereof abutting against the lower surface of said diaphragm;

a first sliding member stopping the peripheral rim of said first inversion plate at the upper surface thereof, and including an annular protrusion at the lower surface thereof and a hollow hole at the center thereof, with the outer periphery thereof sliding directly against the inner wall of said switch case;

a second inversion plate with the upper surface thereof abutting against said annular protrusion, and including a hole at the center portion thereof;

a second sliding member stopping the peripheral rim of said second inversion plate at the upper surface thereof, and including a central axis hole at the center thereof being concentric with said hole and a central projection protruding from the periphery of said central axis hole at the lower surface thereof, with the outer periphery thereof sliding directly against the inner wall of said switch case;

a third inversion plate with the inner periphery thereof interlocking with the side surface of said central projection and with the outer periphery thereof stopped by a step region of the inner wall of said switch case;

a second actuating rod abutting at the upper end thereof against the lower surface of said second inversion plate, and piercing said central axis hole of said second sliding member;

a first actuating rod abutting at the upper end thereof against the lower surface of said first inversion plate, and piercing said hollow hole, said hole, and the interior of said second actuating rod;

a first electric switch segment comprising a first movable contact that connects with the lower end of said first actuating rod, and a fixed contact that comes into contact with said first movable contact; and a second electric switch segment comprising a second movable contact that connects with the lower end of said second actuating rod, and a third movable contact that connects with said central projection and comes into contact with said second movable contact;

wherein said second inversion plate is formed by layering two inversion plates; and the ratio between a diameter Sd of said second inversion plate and a diameter Rd of a circle plotted by the apex of said annular protrusion provided to the lower surface of said first sliding member (Rd/Sd) is within the range of $0.8<(Rd/Sd)<0.9$.

3. A triple action pressure switch comprising:

a housing including a path for introducing fluid pressure;

a switch case interlocking with said housing;

a diaphragm fixed airtightly between said housing and said switch case;

a first inversion plate with the upper surface thereof abutting against the lower surface of said diaphragm;

a first sliding member stopping the peripheral rim of said first inversion plate at the upper surface thereof, and including an annular protrusion at the lower surface thereof and a hollow hole at the center thereof, with the outer periphery thereof sliding directly against the inner wall of said switch case;

a second inversion plate with the upper surface thereof abutting against said annular protrusion, and including a hole at the center portion thereof;

a second sliding member stopping the peripheral rim of said second inversion plate at the upper surface thereof, and including a central axis hole at the center thereof being concentric with said hole and a central projection protruding from the periphery of said central axis hole at the lower surface thereof, with the outer periphery thereof sliding directly against the inner wall of said switch case;

a third inversion plate with the inner periphery thereof interlocking with the side surface of said central projection and with the outer periphery thereof stopped by a step region of the inner wall of said switch case;

a second actuating rod abutting at the upper end thereof against the lower surface of said second inversion plate, and piercing said central axis hole of said second sliding member;

a first actuating rod abutting at the upper end thereof against the lower surface of said first inversion plate, and piercing said hollow hole, said hole, and the interior of said second actuating rod;

a first electric switch segment comprising a first movable contact that connects with the lower end of said first actuating rod, and a fixed contact that comes into contact with said first movable contact; and a second electric switch segment comprising a second movable contact that connects with the lower end of said second actuating rod, and a third movable contact that connects with said central projection and comes into contact with said second movable contact;

wherein said second inversion plate is formed by layering two inversion plates; and the ratio between an inner diameter HSd of a snap disc receiver of said second sliding member and a diameter Rd of a circle plotted by the apex of said annular protrusion provided to the lower surface of said first sliding member (Rd/HSd) is within the range of $0.79<(Rd/HSd)<0.89$.

* * * * *